US005085962A

United States Patent [19]

Aslam et al.

[11] Patent Number: 5,085,962

[45] Date of Patent: Feb. 4, 1992

[54] METHOD AND APPARATUS FOR REDUCING RELIEF IN TONER IMAGES

[75] Inventors: Muhammad Aslam, Rochester; Thomas J. Farnand, Webster, both of N.Y.

[73] Assignee: Eastman Kodak Company, Rochester, N.Y.

[21] Appl. No.: 528,516

[22] Filed: May 25, 1990

[51] Int. Cl.[5] ..... G03G 13/20; G03G 15/20

[52] U.S. Cl. ..... 430/99; 430/124; 355/282; 355/285; 355/295

[58] Field of Search ..... 430/98, 99, 124; 355/282, 285, 295

[56] References Cited

U.S. PATENT DOCUMENTS 4,337,303 6/1982 Sahyun et al. ..... 430/11
4,639,405 1/1987 Franke ..... 430/124
4,780,742 10/1988 Takahashi et al. ..... 156/323

FOREIGN PATENT DOCUMENTS 0301585 2/1989 European Pat. Off. .
47737 4/1977 Japan ..... 355/285

*Primary Examiner*—Roland Martin
*Attorney, Agent, or Firm*—Leonard W. Treash, Jr.

[57] ABSTRACT

A toner image, for example, a multicolor toner image is formed on a thermoplastic layer on a receiving sheet. To fix the image without substantial visible objectionable relief, the toner image is first positioned between two members, one of which has a rough texture to it to apply a texture to the toner image and the thermoplastic layer carrying it. It is then positioned between a pair of smooth surfaced pressure members to reduce the texture and relief and to apply a gloss to the image.

12 Claims, 2 Drawing Sheets

METHOD AND APPARATUS FOR REDUCING RELIEF IN TONER IMAGES

TECHNICAL FIELD

This invention relates to the finishing of toner images and more particularly to a method and apparatus for reducing relief in high-quality toner images, especially multicolor toner images carried on a thermoplastic layer on a receiving sheet.

BACKGROUND ART

In electrophotography, multicolor images having resolution and other qualities comparable to those of silver halide photography have been produced in the laboratory. One reason such systems have not been commercially practical is they have generally required liquid developing for high quality. However, recent advances in fine particle dry toners have made low-grain, high-resolution images feasible with dry systems.

U.S. patent application Ser. No. 07/405,258, filed Sept. 11, 1989, TONER FIXING METHOD AND APPARATUS AND IMAGE BEARING RECEIVING SHEET, to Rimai et al, discusses a problem with such high resolution dry images that when they are put through an ordinary roller fuser they both spread, losing resolution, and exhibit a substantial relief image according to the varying thickness of toner layers in the image. The Rimai et al application suggests using a hard ferrotyping belt to embed the toner in a heat softened thermoplastic layer. The combination of relatively high pressure and the heat softened thermoplastic layer both substantially embeds the toner in the layer substantially reducing the relief without spreading the image and also applies a gloss to the image highly desirable in some applications.

U.S. patent application Ser. No. 07/409,194, filed Sept. 19, 1989, METHOD AND APPARATUS FOR TREATING TONER IMAGE BEARING RECEIVING SHEETS, Baxter et al, deals with texturizing or adding gloss to a toner image-bearing receiving sheet generally of the type described in the Rimai et al application having a toner image on a thermoplastic layer. This application suggests that there are certain advantages if the thermoplastic layer is softened primarily from heat originating in a roller contacting the back of the receiving sheet rather than one contacting the thermoplastic layer itself. This approach eliminates localized areas of high temperature on the surface of the thermoplastic that may encourage offset of the thermoplastic onto the member contacting it. In the Baxter et al preferred embodiment, the image is first fixed using the smooth ferrotyping belt of the Rimai et al application and then texturized with an unheated texturing roller contacting the image with the receiver backed by a heated roller. Good results were obtained in reducing relief and in adding texture without release oils.

The processes in the above two applications are done without the use of fusing oils because fusing oils leave image defects that are unacceptable with photographic quality prints.

U.S. Pat. No. 4,639,405, issued Jan. 27, 1987 to H. G. Franke, shows a post-treatment step to add gloss to a toner image carried on a paper after ordinary fusing. The fixed image bearing paper is dried and then pressed between a pair of heated rollers which increase the gloss of the image. At least one of the rollers has a resin coating to provide some width of nip to aid in heat transfer. A purpose for the drying step is to prevent blistering from steam escaping around the nip when coated paper is used as a receiving sheet.

U.S. Pat. No. 4,780,742, issued Oct. 25, 1988 to Takahashi et al, shows a method of increasing the gloss of a fixed toner image by coating it with a thin sheet in the presence of heat and pressure. The thin sheet packs the image and fuses it together, increasing gloss and removing surface roughness. The sheet is cooled and peeled off. The image appears to be fused on top of the support which has a principal object of providing less scattering for color images on transparencies.

European Patent Application 0301585, published Feb. 1, 1989, shows a glazing sheet used to increase the gloss of either a toner image on a paper backing or a dye and developer in a thermoplastic coating. The glazing sheet is pressed against the paper sheets with moderate pressure and the dye-thermoplastic sheets with substantial pressure. The glazing sheet can be either smooth for a high gloss or dull for a low gloss finish. In one embodiment the glazing sheet has both high and low gloss sections that can be selected.

U.S. Pat. No. 4,337,303, issued June 29, 1982 to Sahyun et al, suggests a method of thermal transfer involving bringing a receiving sheet having a thermoplastic coating into contact with fine toner images in the presence of sufficient heat to soften the thermoplastic coating. The toner is said to be encapsulated by the thermoplastic coating under moderate pressure.

STATEMENT OF THE INVENTION

It is an object of the invention to reduce the visual effects of toner image relief associated with extremely high quality toner images carried by a thermoplastic layer of a receiving sheet.

These and other objects are accomplished by treating the toner image receiving sheet in two steps. In the first step the receiving sheet is positioned between a first pair of pressure members, one of the members having a rough-textured surface. The thermoplastic layer is heated to at least its softening point and sufficient pressure is applied between the members to form a textured surface of toner and thermoplastic on the image-bearing surface. In the second step, the receiving sheet is positioned between a pair of smooth surfaced pressure members in the presence of sufficient heat to soften the thermoplastic layer and to further reduce relief and increase the gloss of the surface.

This approach is essentially a reversal of some of the approaches shown in the Rimai et al and Baxter et al applications. That is, those applications included preferred embodiments in which a high gloss web was first used to reduce relief and embed toner and later a textured web or roller was used to add texture to the image bearing surface. In this invention, we have found that if a texturing step is applied before the glossing step the visual perception of relief in the final image is greatly reduced.

This interesting and useful result we believe to be due to the peaks of the rough textured pressure member have naturally more pressure associated with them than would a smooth surface. Thus, with the texturing process, portions of the image associated with the peaks are better embedded than possible with a smooth surface. The toner associated with the valleys in the roughened texturizing surface remains extended above the thermoplastic surface. When the smooth surface of the second step contacts these areas, the lack of toner in between them causes more pressure be applied to the still protruding toner to embed it in the second step. One way to think of the process is that one portion of the image, that associated with the peaks of the first pressure member is embedded in the first step and those associated with the valleys is embedded in the second step.

A second aspect of this process is that any relief that is, in fact, left after the second step appears far more random in nature and is not strictly according to the image concentration. This gives an appearance that is far less objectionable than an imagewise relief image created by ordinary pressure roller fusing.

According to a preferred embodiment, the first step is accomplished by the combination of means for preheating the receiving sheet and a pair of rollers into which the receiving sheet is fed, with the roller contacting the non-image bearing side of the receiving sheet being heated sufficiently to soften the thermoplastic toner. This structure is similar to the texture applying structure shown in the Baxter et al application referred to above. The second step is best accomplished by the combination of a pressure roller and a ferrotyping web, with the backing roller for the ferrotyping web heated sufficiently to heat the thermoplastic layer to its softening point. Thus, the two mechanisms preferred for carrying out the two steps according to the invention are essentially the same as the mechanisms used for carrying out the two steps shown in the Baxter et al application. However, as pointed out above, they are reversed in their order of application. That is, we have found substantial advantages, especially with an image that is to have as high a gloss as possible, to first reducing the relif by using a texturizing step and later to apply the gloss and finish the relief reduction.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
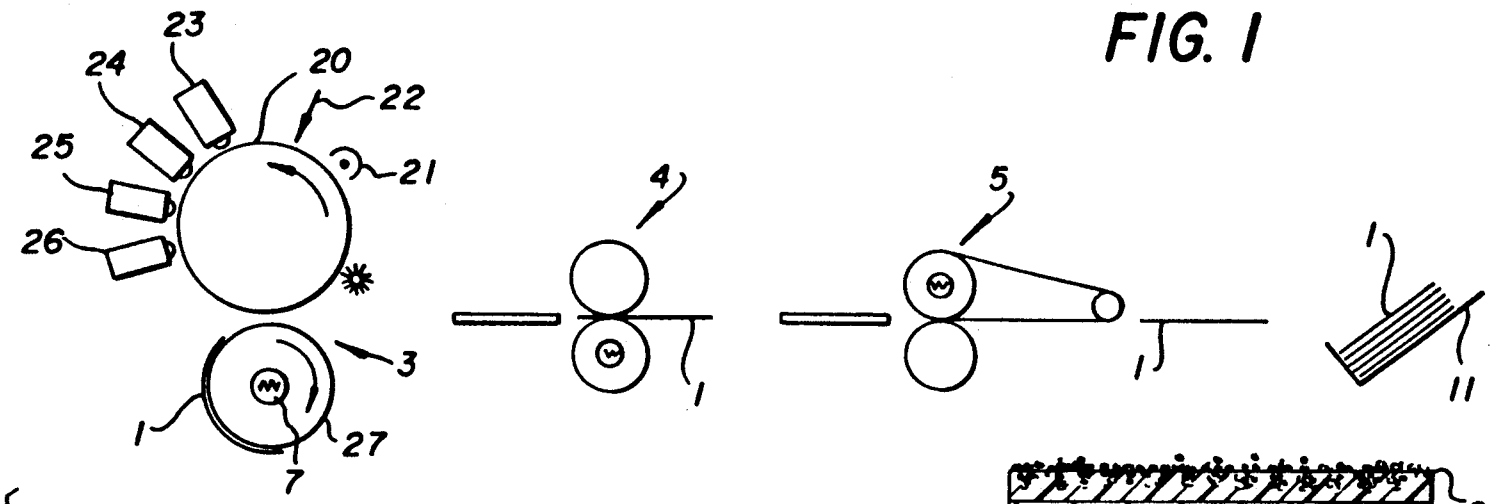
FIG. 1 is a side schematic view of an apparatus for producing finished multicolor toner images.

According to FIG. 1 a receiving sheet 1 is fed along a path through a series of stations. The receiving sheet 1 is shown in section in FIGS. 2-5 and has a paper support 10 with a readily softenable thermoplastic layer 9 coated on its top side. Preferably, the paper support 10 also has a curl preventing coating 8 on its bottom side. These materials will be explained in more detail below.

Receiving sheet 1 is fed through a path past an image transfer station 3, texture applying station 4 and a glossing station 5 and into a receiving hopper 11.

A multicolor toner image can be formed by a number of means on receiving sheet 1. For example, according to FIG. 1, a photoconductive drum 20 is uniformly charged at a charging station 21, exposed by a laser, an LED or an optical exposure device at exposure station 22 and toned by different color toning stations 23, 24, 25 and 26. Consistent with conventional color electrophotography, consecutive images are toned with different colors by toning stations 23-26. The consecutive images are then transferred in registry to the surface of receiving sheet 1 at transfer station 3 where sheet 1 is secured to transfer roller 27 and repetitively brought into transfer relation with the images to form a multicolor toner image thereon. Single color images can also be formed by the same apparatus.

Extremely high-quality electrophotographic color work with dry toner particles requires extremely fine toner particles. Because of difficulties encountered in electrostatically transferring small toner particles, transfer station 3 is preferably of the thermally assisted type, in which transfer is accomplished by heating both the toner and the thermoplastic layer of the receiving sheet causing preferential adherence between the toner and receiving sheet as compared to the toner and whatever surface is carrying it, in this instance photoconductive drum 20. For this purpose, transfer roller 27 is heated by a lamp 7 which heats the thermoplastic layer 9 to its glass transistion temperature which assists in the transfer of the toner to layer 9 by partially embedding the toner in layer 9.

A multicolor image can also be formed using an intermediate drum or web to which two or more color toners are transferred in registry and then transferred as a single multicolor image toner receiving sheet. Sheet 1 can also receive a multicolor image directly from drum 20 in a single transfer. That image is formed on a photoconductive drum 20 by a known process which exposes and develops second, third and fourth color images on top of previously formed color images.

In summary, any of a number of known techniques may be used to provide a multicolor image of dry, extremely fine toner particles on or slightly embedded in the upper thermoplastic surface of the receiving sheet 1.

Figure 2:
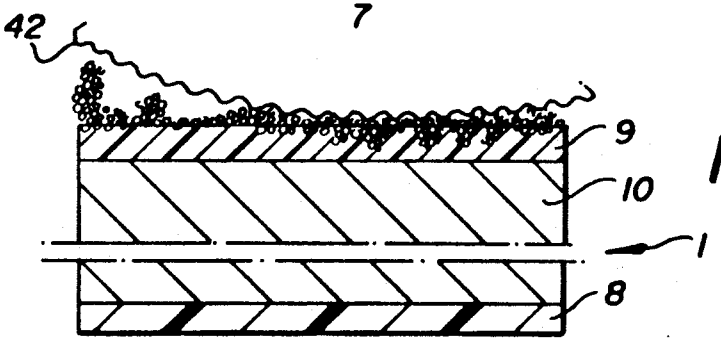

Referring to FIG. 2, these finely-divided toner particles (exaggerated in size in FIG. 2) have a tendency to extend in layers a substantial and varying height above the surface of receiving sheet 1. Ordinary pressure roller fusing has a tendency to flatten somewhat the layers of toner, but also spreads such layers, increasing substantially the granularity of the image and noticeably impairing its quality. Further, the fine toner has a tendency to offset on the pressure fuser unless fusing oils are used. Such fusing oils, while acceptable for ordinary copying work, leave blotches on the sheet surface that are unacceptable for high quality imaging. Pressure roller fusers using one hard roller and one somewhat compliant roller to create a substantial nip for acceptable heat transfer also leave a noticeable relief image in the print, which, for photographic quality is an unacceptable defect. Further, with receiving sheets that are coated on both sides, blistering with such fusers is a significant problem.

Figure 6:
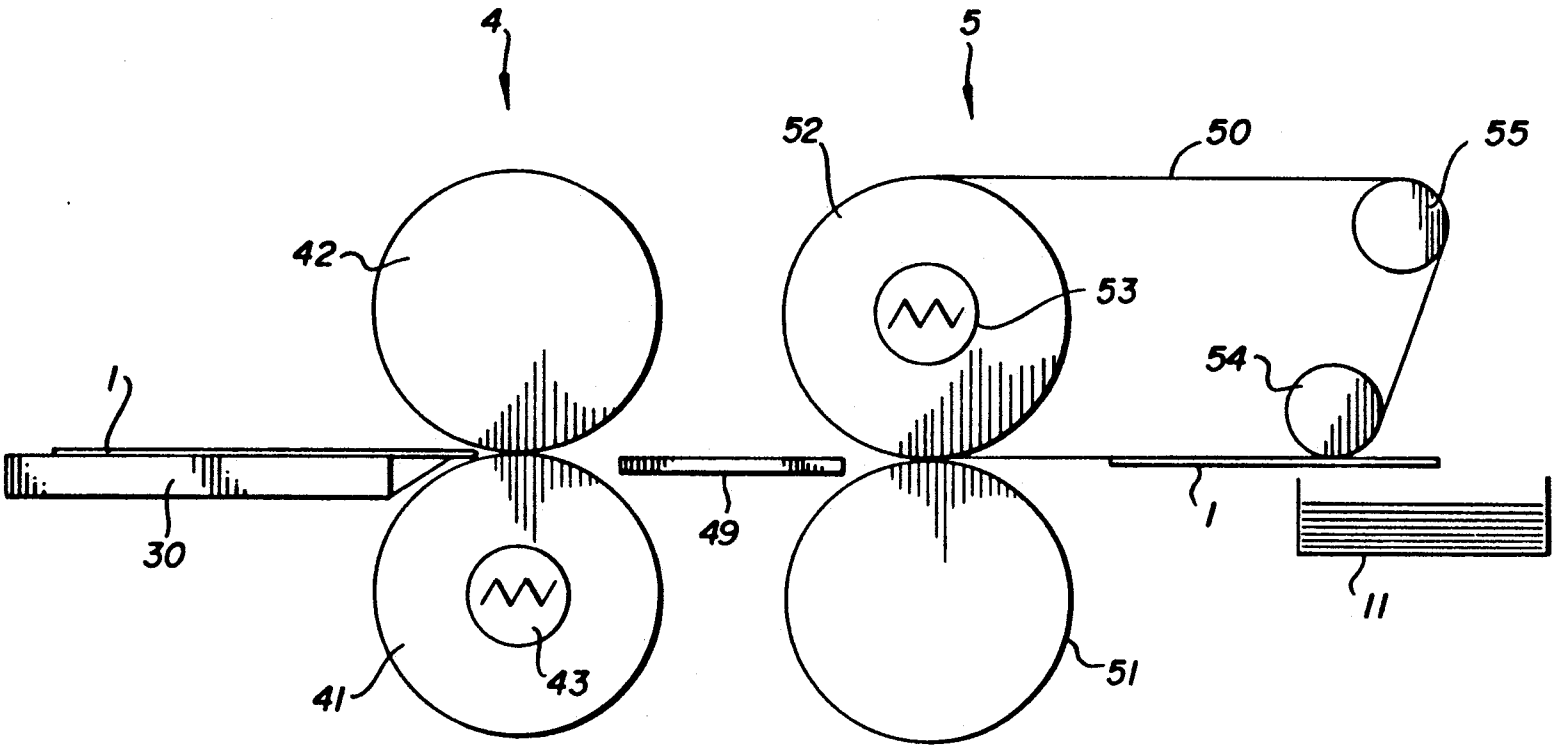
FIG. 6 is a side section of an apparatus for carrying out the invention.

FIG. 6 illustrates an apparatus for both reducing the relief and fixing the toner image in the thermoplastic layer of the receiving sheet. According to FIG. 6, receiving sheet 1 is transported across a preheating device 30 which raises the temperture of the entire receiving sheet 1 to a temperature approaching the glass transition temperature of the thermoplastic layer 9 (FIG. 2). The sheet then is fed into a nip between a pair of pressure members, for example, pressure roller 41 and pressure roller 42. Pressure roller 41 includes a heating element 43 which raises or maintains the temperature of the receiving sheet 1 at a high enough level that the thermoplastic layer 9 is above its glass transition temperature and is therefore softened.

One of the pressure members 41 or 42 has a rough textured surface. Enough pressure, for example, 100 pounds per square inch, is applied between the rollers 41 and 42 to apply a rough textured finish to at least the toner image and in part to the thermoplastic layer.

Receiving sheet 1 is fed by rotation of rollers 41 and 42 to a nip formed by two additional pressure members, for example, roller 51 and belt 50. Belt 50 is backed by a roller 52 and is trained further around smaller rollers 54 and 55. One or both of rollers 51 and 52 is heated. Preferably, roller 52 is heated and also heats belt 50 to maintain the temperature of thermoplastic layer 9 above its glass transition temperature while belt 50 further embeds the toner image in the softened thermoplastic layer 9. Sufficient pressure, for example, 100 pounds per square inch, is applied between roller 51 and 52 to both reduce the relief originally in the image and reduce the relief imparted by the rollers 41 and 42 and to apply a gloss to the surface.

The receiving sheet 1 is driven by rotation of rollers 51 and 52 along with web 50 to the right as shown in FIG. 6. While still in contact with web 50 the toner image cools below its glass transition temperature enabling separation of the receiving sheet from web 50 as web 50 turns around small roller 54, allowing the receiving sheet to fall into tray 11.

Figure 3:
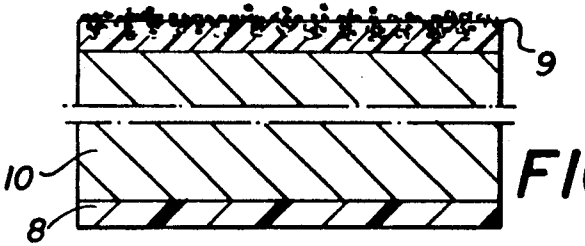
FIGS. 2-5 are side sections greatly magnified illustrating in FIG. 2 the first step of the process, in FIG. 3 the condition of the receiving sheet after the first step, in FIG. 4 the second step of the process and in FIG. 5 the condition of the receiving sheet after the second step.

The effect of the process on the toner image is best illustrated in FIGS. 2–5. The roller 42 has a surface which is rough textured, which texture is exaggerated substantially in FIG. 2. For example, the texture of roller 42 can have a mean peak-to-valley variance of 30 microns. As rollers 41 and 42 exert pressure on receiving sheet 1, the peaks of the surface of roller 42 push toner into the softened layer 9 while the valleys allow some high-frequency relief which is much less image oriented and appears random across the surface. This relief is not nearly as objectionable as the relief that is totally image oriented that is seen when this type of sheet is run through an ordinary pressure roller fuser. To accomplish this without substantial offset of the thermoplastic layer 9 onto roller 42, roller 42 is not heated substantially above the glass transistion temperature of thermoplastic layer 9. Rather, roller 41 applies heat through the receiving sheet (which had already been heated by preheating device 30) to soften layer 9. This approach eliminates a characteristic of localized overheated areas on the surface of layer 9 that would occur if the primary task of heating layer 9 were undertaken by roller 42. With the layer 9 uniformly heated to a temperature slightly above its glass transition temperature, it is not inclined to offset onto roller 42. FIG. 3 thus shows the resulting image after the receiving sheet has left the nip of rollers 41 and 42 and before it reaches the nip of roller 51 and belt 50.

Figure 4:
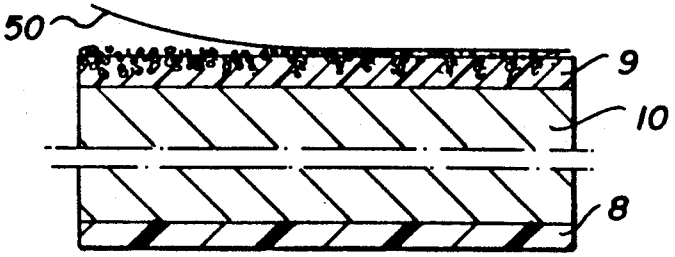

According to FIG. 4, belt 50 which is backed by roller 52 (not shown in FIG. 4) contacts the toner image and layer 9. In order to adequately heat belt 50, the roller backing belt 50, roller 52 is heated internally. In this instance, offset is prevented without fusing oils by permitting the receiving sheet to maintain contact with the web 50 until the toner and the thermoplastic layer 9 are below their glass transition temperatures.

Figure 5:
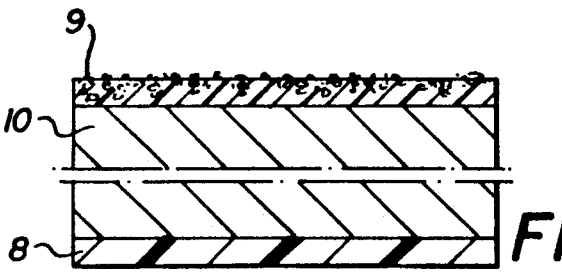

According to FIGS. 4 and 5, belt 50 being hard and smooth pushes the portions of the image that remain above thermoplastic layer 9 down into thermoplastic layer 9 leaving very little relief image left. Whatever relief image is in fact left because of inadequate pressure between belt 50 and roller 51 is of a random high-frequency nature comparable in frequency to that of the roughened surface of roller 42. Again, this relief is not nearly so objectionable to the eye as is the relief image that would result from ordinary pressure roller fusing.

For best results, all four rollers 41, 42, 51 and 52 are hard metal, for example, aluminum rollers. This enables relatively high pressures and good transfer of heat. However, reasonable results can be obtained if the unheated roller 51 is slightly compliant to provide a larger nip. We have found best results are obtained if all four rollers, however, are hard rollers.

A large number of materials can be used for belt 50. Particularly good materials are metal belts, for example, nickel and stainless steel, resin coated metal belts, for example, silicone resin or polytetrafluoroethylene coated metal belts, high melting point thermoplastic belts such as polyethylene, polypropylene and others. For a more complete list of useful materials, see the above-mentioned patent application to Rimai et al which application is incorporated by reference in this application.

Layer 8 of receiving sheet 1 does not offset on either rollers 41 or 51 because it is of a much higher melting point than is layer 9. For example, it can be made of a high melting point polyethylene or polypropylene. However, it does serve the purpose of preventing curl of the materials in and after the process.

With this process, we found that gloss levels of 75 could be obtained with substantially reduced relief despite the fact that the first step in our process is a texturizing step which basically is counter to high gloss levels. Of perhaps more significance, any relief remaining is of a high frequency and far less objectionable than any imagewise relief.

Note that the texturizing surface is shown to be on roller 42. However, it can also be on roller 41. Because only layer 9 is softened by being heated above its glass transition temperature, the texture can be forced through to layer 9 from roller 41 without adversely affecting layer 8 which, although hotter, is still below its glass transition temperature. For more details of this approach, see the Rimai et al application cited above.

The invention has been described in detail with particular reference to a preferred embodiment thereof, but it will be understood that variations and modifications can be effected within the spirit and scope of the invention as described hereinabove and as defined in the appended claims.

We claim:

1. A method of treating a thermoplastic layer on a receiving sheet, said layer carrying a toner image, which toner image exhibits varying levels of relief according to varying amounts of toner making up the image, said method comprising:

positioning said receiving sheet between a first pair of pressure members, one of said members having a rough textured surface, heating said thermoplastic layer to at least its softening point, applying sufficient pressure between said first pair of pressure members to form a texturized surface of toner and thermoplastic, then positioning said receiving sheet between a second pair of smooth surfaced pressure members in the presence of sufficient heat to soften said thermoplastic layers, and applying sufficient pressure between said second pair of pressure members to further reduce said relief and increase the gloss of said surface.

2. A method according to claim 1 wherein said first pair of pressure members are a pair of rollers at least one of which is heated.

3. A method according to claim 2 wherein the roller that is heated is the roller contacting the side of the receiving sheet opposite the toner image.

4. A method according to claim 2 wherein said receiving sheet is heated prior to entering the nip between the first pair of pressure members.

5. The method according to claim 3 wherein said receiving sheet is heated prior to entering the nip between the first pair of pressure members.

6. The method according to claim 1 wherein said second pair of pressure members are a roller and a belt, said belt being backed by a roller, and said sheet stays in contact with said belt until sufficiently cool to separate therefrom without said toner or thermoplastic layer offsetting onto said belt.

7. The method according to claim 6 wherein said roller backing said belt is heated.

8. The method according to claim 2 wherein said second pair of pressure members are a roller and a belt backed by a roller, and said sheet stays in contact with said belt until both said toner and said thermoplastic layer are below its glass transition temperature.

9. The method according to claim 8 wherein said roller backing said belt is heated.

10. The method according to claim 4 wherein said second pair of pressure members are a roller and a belt backed by a roller, and said sheet stays in contact with said belt until both the thermoplastic layer and said toner image are cooled below their glass transition temperature.

11. The method according to claim 5 wherein said second pair of pressure members are a roller and a belt backed by a roller, and said sheet stays in contact with said belt until both said toner image and said thermoplastic layer cool below their glass transition temperature.

12. Apparatus for treating a thermoplastic layer on a receiving sheet, said layer carrying a toner image which toner image exhibits varying levels of relief according to varying amounts of toner making up the image, said apparatus comprising means for first applying a texture to said toner image and thermoplastic layer, and means for then feeding said receiving sheet between a pair of smooth surfaced pressure members to both reduce the texture applied by said texture applying means and to apply a gloss to said toner and thermoplastic layer surface.

* * * * *